US005180067A

United States Patent [19]

Conaway et al.

[11] Patent Number: 5,180,067

[45] Date of Patent: Jan. 19, 1993

[54] SHOWER CADDY

[75] Inventors: Brian J. Conaway, Wooster; Tyrone M. Keyes, Cincinnati, both of Ohio

[73] Assignee: Rubbermaid Incorporated, Wooster, Ohio

[21] Appl. No.: 816,568

[22] Filed: Jan. 3, 1992

[51] Int. Cl.[5] ..... A47F 7/00

[52] U.S. Cl. ..... 211/119; 211/16

[58] Field of Search ..... 211/119, 113, 181, 16, 211/90, 189

[56] References Cited

U.S. PATENT DOCUMENTS

| | | | |
|---|---|---|---|
| D. 154,903 | 8/1949 | Caldwell | D4/3 |
| D. 233,639 | 11/1974 | Wooters | D6/4 |
| D. 274,393 | 6/1984 | Sinchok | D6/86 |
| D. 320,134 | 9/1991 | Emery | D6/525 |
| 3,059,374 | 10/1962 | Bernay | 211/113 |
| 3,181,702 | 5/1965 | Raphael | 211/119 |
| 3,789,996 | 2/1974 | Stroh | 211/119 |
| 3,923,162 | 12/1975 | Hussey | 211/119 |
| 4,387,811 | 6/1983 | Ragir et al. | 211/119 |
| 4,541,131 | 9/1985 | Sussman | 211/119 X |
| 4,573,591 | 3/1986 | Chap | 211/113 |

OTHER PUBLICATIONS

Selfix, Inc., 4501 W. 47th Street, Chicago, Ill. 60632, 3 pages advertising, 1990.

Better Bath, Division of Better Sleep, Inc., Berkeley Heights, N.J. 07922, 1 page avertisement, date unknown.

Sally Designs Ltd., P.O. Box 161, Glencoe, Ill. 60022 (1984); Colette Shower Caddy, Waterbury Companies, Inc., P.O. Box 1812, Waterbury, Conn. 08722 (1988) 1 advertising sheet.

Lillian Vernon/Hold Everything Bath Essentials, 1 page advertisement, 1991.

Cosmepak, Div. of FPI Thermoplastic Technologies, P.O. Box 1907, Morristown, N.J. 07962, 1 page advertisement, date unknown.

Tucker Housewares, 1 page advertisement, 1990.

Creative Bath, Crystal Clear Super Shower Caddy, 1 page advertisement, date unknown.

Artwire, 1 page advertisement, date unknown.

Grayline Housewares, 1 page advertisement, date unknown.

Lee-Rowan Space Solvers, 1 page advertisement, date unknown.

Rubbermaid Incorporated, Wooster, Ohio 44691, Rubbermaid II Bath Collection, 3 page brochure, 1979.

*Primary Examiner*—Alvin C. Chin-Shue
*Assistant Examiner*—Sarah A. Lechok
*Attorney, Agent, or Firm*—Renner, Kenner, Greive, Bobak, Taylor & Weber

[57] ABSTRACT

A shower caddy (10) includes a wire portion (11) and a plastic portion (12). The wire portion (11) is formed with upper foot wires (45, 46) to engage grooves (73) in the plastic portion (12) and with a rear support wire (51) to engage lock tabs (74) in the plastic portion (12) so that the plastic portion (12) may be removably carried by the wire portion (11). The wire portion (11) has two spaced apart wires (14,15) interconnected by a loop wire (16) to engage the top of a neck pipe of a shower head. A bracket (17) is engageable with and slidable along the wires (14, 15) to engage the bottom of the neck pipe. The wire portion (11) also includes adjacent spaced-apart shelf wires (35, 36, 37, 38) with two adjacent shelf wires (36, 37) having opposed arcuate portions (41, 42) formed therein to hold a bottle in an inverted position therebetween. The plastic portion (12) includes soap trays (61, 62) formed therein. The soap trays (61, 62) have outwardly flaring side walls (64, 67) and bottom surfaces (65, 68). The bottom surface (68) of the soap tray (62) is sloped upwardly from the rear of the side walls (67) to the front of the side walls (67) so that soap in the soap tray (62) can be readily removed therefrom.

47 Claims, 4 Drawing Sheets

SHOWER CADDY

TECHNICAL FIELD

This invention relates to a bathroom accessory commonly known as a shower caddy. More particularly, this invention relates to a wire based shower caddy with a plastic insert, the shower caddy being readily adapted to engage the neck of a shower head and being configured to conveniently hold a variety of shower accessories for facile removal therefrom.

BACKGROUND ART

Bathroom accessories commonly known as shower caddies, which are adapted to be mounted on a wall within a shower stall or bath tub or adapted to be hung from the neck of a shower head, are known in the art. Such shower caddies are usually made of a wire or plastic material and are configured to hold shower accessories such as soap, shampoo, razors, towels, washcloths and the like. However, in known configurations the shampoo bottles, for example, can only be placed on a shelf in their upright positions and, as such, as the bottles become empty, extraction of the shampoo can be a time-consuming and irritating process for the user. In addition, the shelves of known shower caddies are not configured to be conducive to the facile removal of soap therefrom, particularly as a wet bar of soap becomes small and difficult to grasp.

Moreover, unless permanently affixed to the shower wall, the prior art has provided no suitable means of stably and temporarily mounting the shower caddies. Many wire shower caddies loosely hang from the neck of the shower head and are thus quite susceptible to being tipped or oscillated. Others are provided with a top in which the wires are spaced close together with it being intended that the top of the shower caddy be snapped over the neck of the shower head. However, since there is minimal constant tension being placed on the wires, and with only friction being relied upon to keep the shower caddy from tilting, such a configuration is not satisfactory, particularly after the spaced wires become more separated after prolonged use and after the caddy has been removed and remounted several times, as would be necessary for cleaning purposes.

With respect to cleanability, the prior art shower caddies, and in particular those constructed of wire, are difficult to clean and, as indicated above, require repeated removals from their mount when it is desired to do so. In short, the known prior shower caddies are deficient in many aspects, with such deficiencies being addressed by the present invention.

DISCLOSURE OF THE INVENTION

It is thus a primary object of the present invention to provide a shower caddy which is constructed of both a wire and a plastic material to take advantage of the advantages derived from both constructions.

It is another object of the present invention to provide a shower caddy, as above, in which the portion that is in most frequent need of cleaning, that is, the plastic portion, is readily removable from the wire portion.

It is an additional object of the present invention to provide a shower caddy, as above, which is easy to mount to the neck of the shower head.

It is a further object of the present invention to provide a shower caddy, as above, which is essentially locked in place on the neck of the shower head thereby prohibiting the inadvertent tipping of the shower caddy and its contents.

It is a still further object of the present invention to provide a shower caddy, as above, in which the soap holding area is configured so as to permit the facile removal of bars of soap therefrom.

It is yet another object of the present invention to provide a shower caddy, as above, which is configured so that bottles may be optionally held in an inverted position so that the contents thereof are near the mouth of the bottle at all times for quick dispensing of the contents thereof.

These and other objects of the present invention, as well as the advantages thereof over existing art forms, which will become apparent from the description to follow, are accomplished by the improvements hereinafter described and claimed.

In general, a shower caddy according to the concepts of the present invention includes a wire portion and a plastic portion. The wire portion is configured to engage the plastic portion and the plastic portion is configured to releasably lockingly receive the wire portion so that the plastic portion may be removably attached to the wire portion.

In accordance with another aspect of the invention, the wire portion includes spaced apart neck wires interconnected by a loop wire which is adapted to rest upon the top of the neck pipe of a conventional shower head. A bracket is positionable on and engages the neck wires such that it can be slid along the neck wires to engage the underside of the neck pipe to temporarily attach the shower caddy to the neck pipe.

The wire portion also includes a horizontally oriented shelf for holding shower accessories. The shelf is defined by a plurality of generally parallel spaced-apart shelf wires. At least two adjacent of the shelf wires are provided with opposed arcuate portions to receive and hold a bottle in an inverted position.

The plastic portion includes at least one soap tray having outwardly flaring side walls and a bottom surface. The bottom surface is sloped upwardly from the rear side wall to the front side wall to facilitate removal of soap from the tray.

A preferred exemplary shower caddy incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
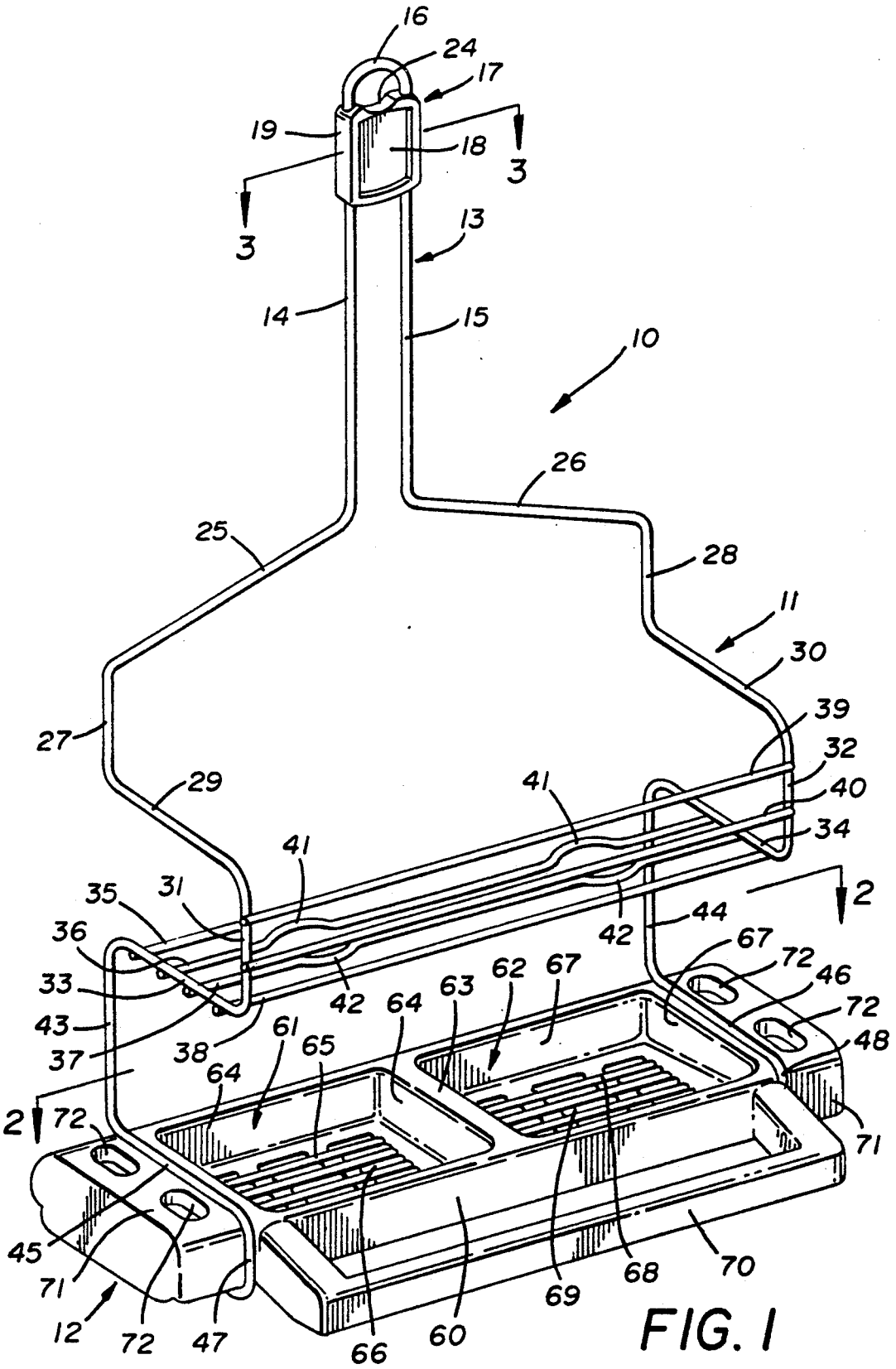
FIG. 1 is a perspective view of a shower caddy according to the concepts of the present invention.
Figure 2:
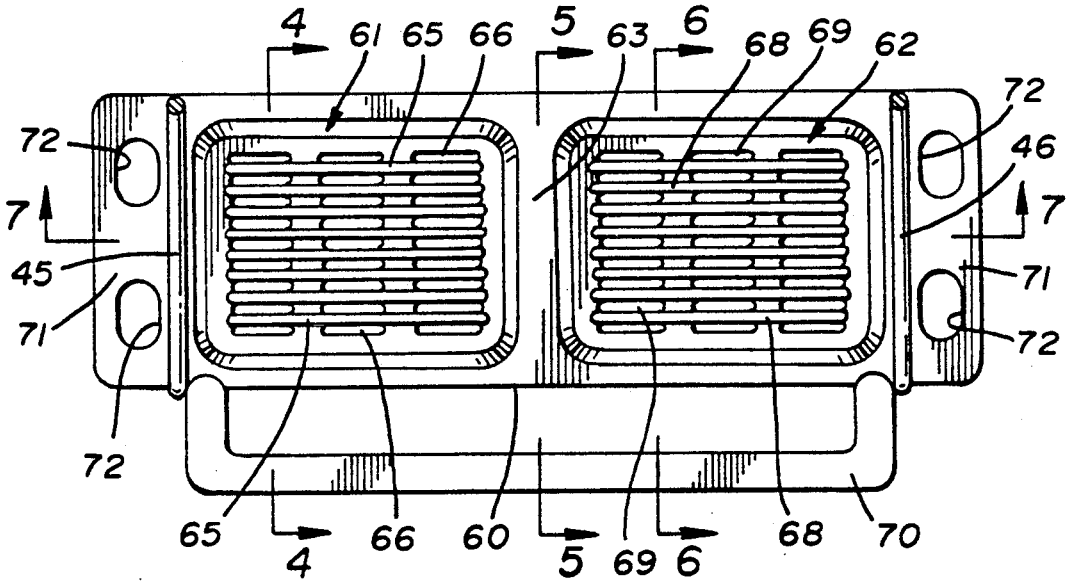
FIG. 2 is a plan view of a portion of the shower caddy shown in FIG. 1 being taken substantially along line 2—2 of FIG. 1.

A shower caddy according to the concepts of the present invention is indicated generally by the numeral 10 in FIG. 1 and includes a wire portion, indicated generally by the numeral 11, and a plastic tray portion indicated generally by the numeral 12. While wire portion 11 could be fabricated solely from metallic or chrome plated wire, it is preferably formed of a plastic, for example polyethylene, coated metallic wire. When reference is made to "wire" herein, it is therefore to be understood that either pure metallic wire or a plastic coated wire material is contemplated. Similarly, plastic tray portion 12 could be made of any rigid plastic such as polypropylene.

Figure 3:
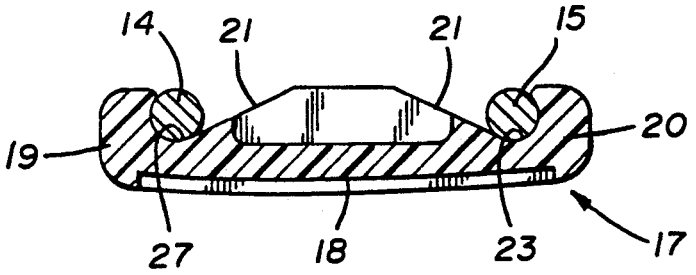
FIG. 3 is a sectional view taken substantially along line 3—3 of FIG. 1 and showing the means by which the shower caddy may be installed onto the neck of a shower head.
Figure 4:
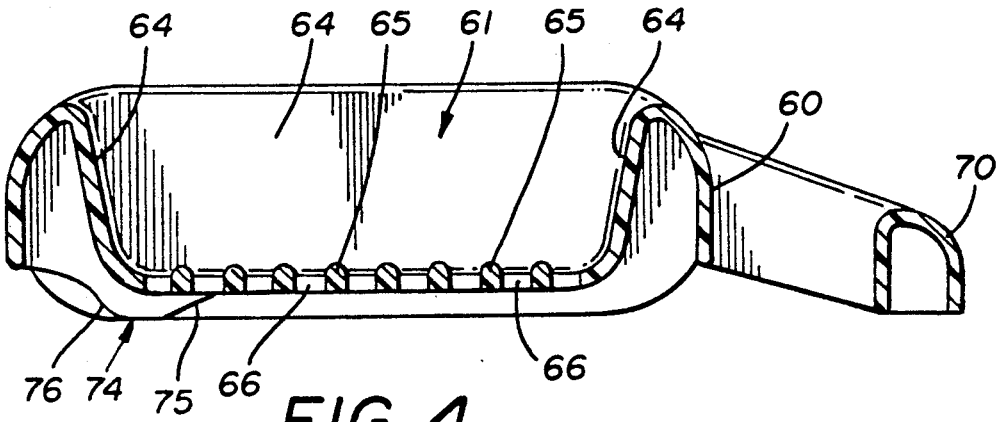
FIG. 4 is a sectional view taken substantially along line 4—4 of FIG. 2.
Figure 5:
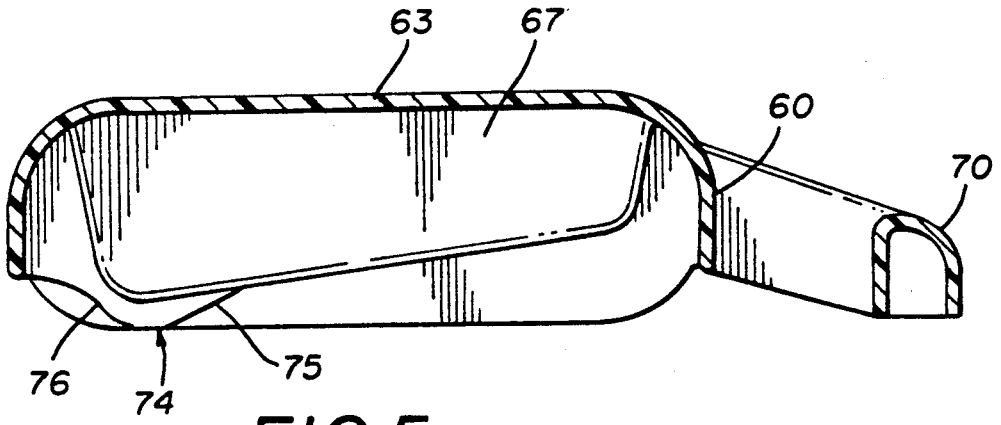
FIG. 5 is a sectional view taken substantially along line 5—5 of FIG. 2.
Figure 6:
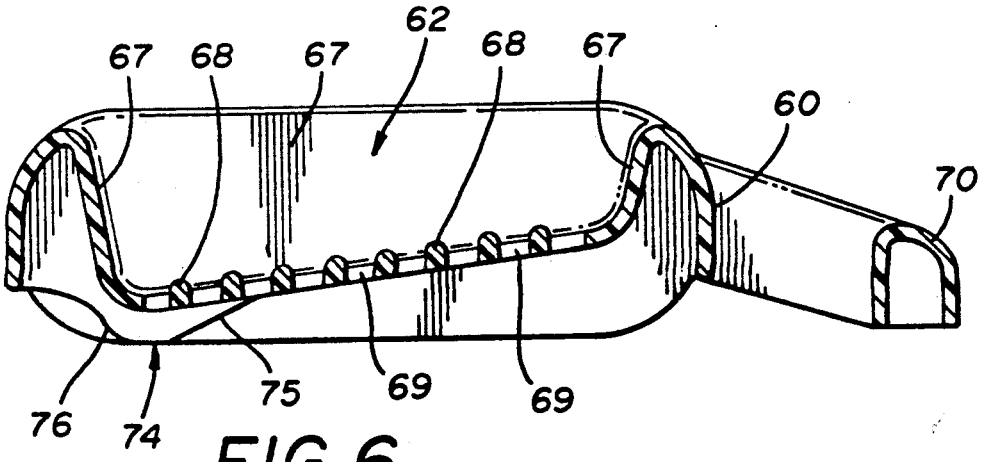
FIG. 6 is a sectional view taken substantially along line 6—6 of FIG. 2.

As best shown in FIG. 1, the upper end of wire portion 11 is formed as a neck portion, indicated generally by the numeral 13, which includes spaced upright wires 14, 15 integrally connected at their tops by a loop 16. Loop 16 is adapted to rest on the top of the neck of a conventional shower head, the neck being the pipe that delivers water to the shower head. A retaining slide bracket, indicated generally by the numeral 17, is provided to engage the underside of the shower neck to firmly hold shower caddy 10 to the shower neck. Bracket 17, which can be formed of any suitable plastic material, includes a front face 18 having wire engaging side members 19, 20 extending generally laterally and rearwardly therefrom as best shown in FIG. 3. The rear of bracket 17 is formed with two ramp surfaces 21 extending between side members 19 and 20 which at their outer ends form, with side members 19 and 20, wire sockets 22 and 23, respectively.

The spacing of wires 14 and 15 relative to the spacing of sockets 22 and 23 is such that in the normal operating position, wires 14 and 15 are within sockets 22 and 23, respectively, with the normal spring-bias of the wires urging them toward side members 19 and 20, respectively. To install shower caddy 10 on a shower head neck, the user merely grasps neck portion 13 and by flexing wires 14 and 15 toward each other, they will slide along ramp surfaces 21 of bracket 17, and bracket 17 will thereby release the wires and can be removed. Then neck portion 13 may be placed over the shower neck pipe by placing it between wires 14 and 15. Shower caddy 10 will thus hang on the shower neck which is engaged at its top by loop 16. Of course, at this point shower caddy 10 will only loosely engage the shower neck and like the prior art, could oscillate about the shower neck. However, by again grasping wires 14 and 15 and moving them toward each other, bracket 17 can be placed into position anywhere along wires 14 and 15, and upon release of wires 14 and 15, they will slide along ramp surfaces 21 and into sockets 22 and 23, respectively. Bracket 17 may then be manually slid upwardly along wires 14 and 15 until the top arcuate edge 24 (FIG. 1) thereof pinches the shower neck against loop 16. The shower head neck is thereby firmly engaged between bracket edge 24 and loop 16 to hold shower caddy 10 firmly in place. Of course, to remove shower caddy 10, one need merely pinch wires 14 and 15 together and remove bracket 17.

Continuing with the discussion of the configuration of wire portion 11, outwardly extending and downwardly angled shoulder wires 25 and 26 are integrally formed at the bottoms of wires 14 and 15, respectively. The outer ends of shoulder wires 25, 26 turn downwardly, as at 27 and 28, respectively, and terminate as forwardly directed arm wires 29 and 30, respectively. Arm wires 29 and 30 turn downwardly, as at wires 31 and 32, respectively, which terminate at integrally formed and rearwardly directed shelf support wires 33 and 34, respectively.

A plurality of generally horizontally oriented shelf wires 35, 36, 37 and 38 span and are attached to wires 33 and 34 to form a shelf or platform for the storage of any shower accessory, such as bottles or the like. Front restraining wires 39 and 40 span and are attached to wires 31 and 32 to prevent items stored on the shelf formed by wires 35, 36, 37 and 38 from falling forwardly out of shower caddy 10.

With bottles positioned on the shelf, the liquid, for example, shampoo contained therein will, of course, be located at the bottom of the bottle. As the bottle approaches being empty, such can be irritating to the user inasmuch as he must tip the bottle and wait until the usually thick and slow flowing liquid comes to the mouth thereof to dispense the same. To save the user time in this regard, wire portion 11 is formed so that one or more bottles can be stably held in an inverted position so that whatever liquid remains therein resides near the mouth thereof for quick dispensing therefrom. To this end, two adjacent of the shelf wires, for example, wires 36 and 37, are formed with opposed arcuate portions 41 and 42, respectively. Arcuate portions 41 and 42 lie on the circumference of a circle generally of a size slightly smaller than the conventional bottle cap so that the cap can be snapped between arcuate portions 41 and 42 and held therebetween to position the bottle upside-down on the shelf. While two opposed portions 41 and 42 are shown as being formed in wires 36 and 37, respectively, to hold two inverted bottles, it should be evident that the shelf could be formed with additional or fewer such configurations without departing from the concepts of this invention.

Figure 7:
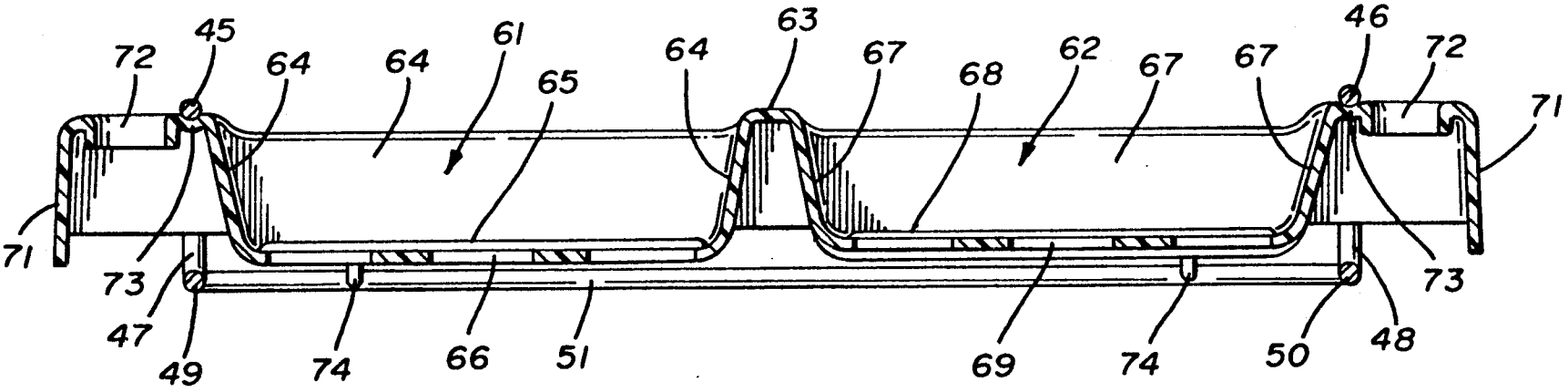
FIG. 7 is a sectional view taken substantially along line 7—7 of FIG. 2.

Wire portion 11 also includes wires 43 and 44 integrally formed at, and downturned from, the back end of wires 33 and 34, respectively. If desired, wires 43 and 44 may carry conventional suction cups (not shown) to hold shower caddy 10 securely against the shower wall. The bottom of wires 43 and 44 turn and form forwardly directed upper foot wires 45 and 46, respectively, which turn downwardly, as at 47 and 48, respectively, and then turn rearwardly to form lower foot wires 49 and 50, respectively (FIG. 7), which are generally parallel to upper foot wires 45 and 46. As shown in FIG. 7, the rear ends of lower foot wires 49 and 50 are interconnected by a laterally extending rear support wire 51 integrally formed with wires 49 and 50. As will hereinafter be described, plastic tray portion 12 removably fits between upper foot wires 45 and 46 and lower foot wires 49 and 50, being temporarily supported by support wire 51. It should be appreciated that with the exception of shelf wires 35, 36, 37 and 38, and restraining wires 39 and 40, wire portion 11 can be formed of one continuous piece of wire forming a totally closed loop from loop portion 16 at the top through rear support wire 51 at the bottom.

The plastic portion 12 of shower caddy 10 includes an elongate body member 60 in which soap trays, generally indicated by the numerals 61 and 62. are formed. trays 61 and 62 being separated by a dividing wall 63. While two trays are shown, it should be evident that depending on the size of shower caddy 10, only one tray might be provided or even more than two trays could be provided without departing from the concepts of the present invention. Each tray which is provided should be of a size to hold a conventional bar of soap.

As shown, tray 61 is formed with walls 64 which flare outwardly as they extend upwardly, and a generally horizontal bottom surface 65 consisting of a plurality of bars and having recessed drainage apertures 66 therein. Tray 62 is likewise formed with walls 67 which flare outwardly as they extend upwardly. However, the bottom surface 68 of tray 62, which likewise consists of a plurality of bars having recessed drainage apertures 69 therein, is shown as not being horizontal. Rather it is shown as being angled upwardly, from rear to front, at an angle of approximately 8°, thereby creating a shorter front wall 67 than front wall 64 of tray 61. As such, it has been found that many users can more easily grasp and remove a slippery bar of soap, particularly when it is getting smaller. Thus, the bar will slide upward along the 8° ramp and easily up the shorter inclined front wall 67. While it has been found that an 8° incline is preferred, any reasonable incline, such as in the range of 5° to 20°, would also achieve the desired results. Although shower caddy 10 has been shown with one tray 61 having a horizontal bottom surface 65 and another tray 62 having an inclined bottom surface 68, it should be evident that both trays could have the desirable inclined surface, shower caddy 10 being depicted with both types of surfaces so as to give the user a choice depending on preference.

Shower caddy 10 can also be provided with a towel holding bar 70 which is shown as extending outwardly from the front of and near the ends of body member 60 of plastic portion 12. In addition, each end of body member 60 can be provided with laterally extending ears 71 having apertures 72 therein. Such are adapted to receive shower utensils of the type, for example, having handles such as razors, brushes or the like.

Because the components of plastic portion 12 are usually in need of more frequent cleaning, it is preferably designed to be removably attached to wire portion 11. To that end, wire receiving grooves 73 (FIG. 7) are provided at the top of body member 60 between ears 71 and trays 61 and 62, and a plurality of lock tabs 74 can depend from the bottom of body member 60. To insert plastic portion 12 into wire portion 11, towel holding bar 70 is laterally positioned between foot wires 45, 49 and foot wires 46, 50 and body member 60 is vertically positioned between upper foot wires 45, 46 and lower foot wires 49, 50. Then plastic portion 12 is moved from the rear of wire portion 11 forwardly as upper foot wires 45 and 46 ride in and otherwise engage grooves 73 in body member 60. Rear support wire 51 will then contact tabs 74, riding up the ramped surfaces 75 thereof and snap over behind an arcuate lock surface 76 formed in tabs 74. Plastic portion 12 is thereby held in place but can easily be removed by merely slightly lifting the rear edge thereof to release support wire 51 from arcuate surface 76 and then sliding it out the back of wire portion 11.

It should thus be evident that the combined plastic and wire shower caddy constructed according to the concepts of the present invention can be firmly attached to the neck of a shower head to hold articles of numerous configuration in a convenient fashion and thus accomplishes the objects of the invention thereby improving the art.

We claim:

1. A shower caddy for holding shower accessories comprising a wire portion for holding the shower accessories and a plastic portion for holding the shower accessories, said wire portion being configured to includes means to engage said plastic portion, said means to engage including generally horizontally oriented upper foot wires, and said plastic portion including a body member having grooves therein to receive said upper foot wires so that said plastic portion may be removably carried by said wire portion.

2. A shower caddy according to claim 1 wherein said wire portion includes lower foot wires spaced from said upper foot wires, said body member being insertable in the space between said upper and lower foot wires.

3. A shower caddy according to claim 1 wherein said means to engage said plastic portion further includes a rear support wire, said body member having lock tabs extending outwardly therefrom to engage said rear support wire.

4. A shower caddy according to claim 3 wherein each said lock tab includes a ramped surface on which said rear support wire can slide during attachment of said plastic portion to said wire portion and an arcuate lock surface in which said rear support wire is positioned when said plastic portion is attached to said wire portion.

5. A shower caddy according to claim 1 further comprising means to mount said wire portion to the neck pipe of a shower caddy.

6. A shower caddy according to claim 5 wherein said means to mount includes a neck portion formed in said wire portion and defined by two spaced apart wires, a wire loop interconnecting said spaced apart wires and a bracket positionable on and engaging said spaced apart wires, said bracket being movable along said spaced apart wires so that the neck pipe is engageable between said wire loop and said bracket.

7. A shower caddy according to claim 1 further comprising means formed in said wire portion to hold a shower accessory in an inverted position.

8. A shower caddy for holding shower accessories comprising a wire portion for holding the shower accessories and a plastic portion for holding the shower accessories, a plurality of generally horizontally oriented spaced apart wires formed in said wire portion, at least two of said wires having opposed arcuate portions formed therein to receive the shower accessory in an inverted position therebetween, said wire portion being configured to include means to engage said plastic portion, and said plastic portion including means to receive said means to engage so that said plastic portion may be removably carried by said wire portion.

9. A shower caddy according to claim 7 further comprising means to mount said wire portion to the neck pipe of a shower head.

10. A shower caddy according to claim 1 further comprising at least one soap tray formed in said plastic portion, and means in said soap tray to facilitate the removal of soap therefrom.

11. A shower caddy according to claim 10 wherein said means in said soap tray includes a bottom surface sloping upwardly from the rear of said soap tray to the front of said soap tray.

12. A shower caddy according to claim 10 further comprising means to mount said wire portion to the neck pipe of a shower head.

13. A shower caddy according to claim 10 further comprising means formed in said wire portion to hold a shower accessory in an inverted position.

14. A shower caddy according to claim 13 further comprising means to mount said wire portion to the neck pipe of a shower head.

15. A shower caddy for holding shower accessories and being attachable to the neck pipe of a shower head comprising a wire portion for holding the shower accessories, said wire portion including a neck portion defined by two spaced apart wires and a wire loop interconnecting said wires, and a slide bracket positionable on said wires, said slide bracket including a front face, side members extending rearwardly from said front face, and ramp surfaces on the back thereof, said side members engaging said wires, said slide bracket being movable along said wires so that the neck pipe is engageable between said wire loop and said slide bracket.

16. A shower caddy according to claim 15, said bracket including a wire receiving socket formed between each said ramp surface and each said side member.

17. A shower caddy according to claim 15 further comprising means to hold a shower accessory in an inverted position.

18. A shower caddy according to claim 17 further comprising a plastic portion for holding the shower accessories, at least one soap tray formed in said plastic portion, and means in said soap tray to facilitate the removal of soap therefrom.

19. A shower caddy according to claim 18 further comprising means to attach said plastic portion to said wire portion.

20. A shower caddy according to claim 15 further comprising a plastic portion for holding the shower accessories, at least one soap tray formed in said plastic portion, and means in said soap tray to facilitate the removal of soap therefrom.

21. A shower caddy according to claim 15 further comprising a plastic portion for holding the shower accessories and means to attach said plastic portion to said wire portion.

22. A shower caddy according to claim 21 further comprising means to hold a shower accessory in an inverted position.

23. A shower caddy according to claim 21 further comprising at least one soap tray formed in said plastic portion, and means in said soap tray to facilitate the removal of soap therefrom.

24. A shower caddy for holding shower accessories comprising a wire portion including a generally horizontally oriented shelf for holding the shower accessories, said shelf being formed by a plurality of adjacent spaced-apart wires, at least two adjacent of said wires having opposed arcuate portions formed therein to receive a portion of a shower accessory therebetween.

25. A shower caddy according to claim 24 wherein the shower accessory is a bottle having a cap, said opposed arcuate portions being adapted to engage the cap to hold the bottle in an inverted position.

26. A shower caddy according to claim 24 wherein said wire portion includes support wires, said adjacent spaced-apart wires being carried by said support wires.

27. A shower caddy according to claim 24 further comprising a plastic portion for holding the shower accessories, at least one soap tray formed in said plastic portion, and means in said soap tray to facilitate the removal of soap therefrom.

28. A shower caddy according to claim 27 further comprising means to attach said plastic portion to said wire portion.

29. A shower caddy according to claim 28 further comprising means to mount said wire portion to the neck pipe of a shower head.

30. A shower caddy according to claim 24 further comprising a plastic portion for holding the shower accessories and means to attach said plastic portion to said wire portion.

31. A shower caddy according to claim 30 further comprising means to mount said wire portion to the neck pipe of a shower head.

32. A shower caddy according to claim 24 further comprising means to mount said wire portion to the neck pipe of a shower head.

33. A shower caddy according to claim 32 further comprising a plastic portion for holding the shower accessories, at least one soap tray formed in said plastic portion, and means in said soap tray to facilitate the removal of soap therefrom.

34. A shower caddy comprising a plastic portion having at least one soap tray, said soap tray having outwardly flaring side walls and a bottom surface upon which soap in the tray can rest, said bottom surface being sloped upwardly from the rear side wall f said side walls to the front side wall of said side walls so that the soap in said soap tray may be readily removed therefrom by sliding it on said sloped bottom surface.

35. A shower caddy according to claim 34 further comprising a second soap tray having outwardly flaring side walls and a generally horizontal bottom surface.

36. A shower caddy according to claim 35 wherein said bottom surfaces of said soap trays have apertures therein.

37. A shower caddy according to claim 34 wherein the slope of said bottom surface is in the range of approximately five to twenty degrees.

38. A shower caddy according to claim 34 further comprising a wire portion, and means to attach said plastic portion to said wire portion.

39. A shower caddy according to claim 38 further comprising means to mount said wire portion to the neck pipe of a shower head.

40. A shower caddy according to claim 38, said wire portion including means to hold a shower accessory in an inverted position.

41. A shower caddy according to claim 40 further comprising means to mount said wire portion to the neck pipe of a shower head.

42. A shower caddy according to claim 34 further comprising a wire portion including means to hold a shower accessory in an inverted position.

43. A shower caddy according to claim 42 further comprising means to mount said wire portion to the neck pipe of a shower head.

44. A shower caddy according to claim 34 further comprising means to mount said wire portion to the neck pipe of a shower head.

45. A shower caddy for holding shower accessories and being attachable to the neck pipe of a shower head comprising a wire portion and a plastic portion; said wire portion having two spaced apart wires defining a neck and a wire loop interconnecting said spaced apart wires; bracket means positionable on and engaging said spaced apart wires; said bracket means being movable along said spaced apart wires to engage the neck pipe against said wire loop; said wire portion also including a plurality of generally horizontally oriented adjacent spaced-apart wires forming a shelf for the shower accessories, at least two adjacent of said generally horizontally oriented spaced-apart wires having opposed arcuate portions formed therein to receive a portion of a shower accessory; said wire portion being configured to include means to engage said plastic portion; said plastic portion including means to receive said means to engage so that said plastic portion may be removably carried by said wire portion; said plastic portion also having at least one soap tray with outwardly flaring side walls and a bottom surface, said bottom surface being sloped upwardly from the rear side wall of said side walls to the front side wall of said side walls so that soap in said soap tray may be readily removed therefrom.

46. A shower caddy according to claim 45, said plastic portion including a towel receiving bar extending outwardly therefrom.

47. A shower caddy according to claim 45, said plastic portion including ears extending outwardly therefrom, said ears having apertures therein adapted to receive the handle of a shower accessory.

* * * * *